United States Patent [19]

Wylde

[11] Patent Number: 4,962,618

[45] Date of Patent: Oct. 16, 1990

[54] LENS LAPPING PAD

[75] Inventor: Stephen J. Wylde, Surrey, England

[73] Assignee: J & S Wylde, Ltd., Surrey, England

[21] Appl. No.: 467,182

[22] Filed: Jan. 19, 1990

Related U.S. Application Data

[63] Continuation of Ser. No. 133,380, Dec. 15, 1987, abandoned.

[30] Foreign Application Priority Data

Dec. 16, 1986 [GB] United Kingdom ..... 8630049

[51] Int. Cl.[5] ..... B24D 11/02

[52] U.S. Cl. ..... 51/395; 51/297; 51/405; 51/407; 51/DIG. 34

[58] Field of Search ..... 51/394, 395, 398, 401, 51/DIG. 34, 297, 405, 406, 407, 309

[56] References Cited

U.S. PATENT DOCUMENTS

| | | | |
|---|---|---|---|
| 369,431 | 9/1887 | Brown | 51/DIG. 34 X |
| 2,752,738 | 7/1956 | Seifert | 51/DIG. 34 X |
| 3,144,737 | 8/1964 | Faas | 51/395 |
| 3,324,608 | 6/1967 | Hoenig | 51/395 |
| 4,019,289 | 9/1977 | Korver | 51/395 |
| 4,086,068 | 4/1978 | Hedin | 51/395 |
| 4,162,899 | 7/1979 | Molnar et al. | 51/401 X |
| 4,274,232 | 6/1981 | Wylde | 51/DIG. 34 X |
| 4,555,250 | 11/1985 | Horie et al. | 51/309 |
| 4,644,703 | 2/1987 | Kaczmarek et al. | 51/401 |

FOREIGN PATENT DOCUMENTS

| | | | |
|---|---|---|---|
| 2039810 | 8/1980 | United Kingdom | 51/395 |

*Primary Examiner*—Frederick R. Schmidt
*Assistant Examiner*—M. Rachuba
*Attorney, Agent, or Firm*—Berman, Aisenberg & Platt

[57] ABSTRACT

A lens lapping pad comprising a zinc alloy foil having a thickness of about 0.1 mm, and a backing of cloth impregnated with a pressure sensitive adhesive, to give an overall pad thickness of about 0.5 mm. A peelable cover may protect the cloth backing.

17 Claims, 3 Drawing Sheets

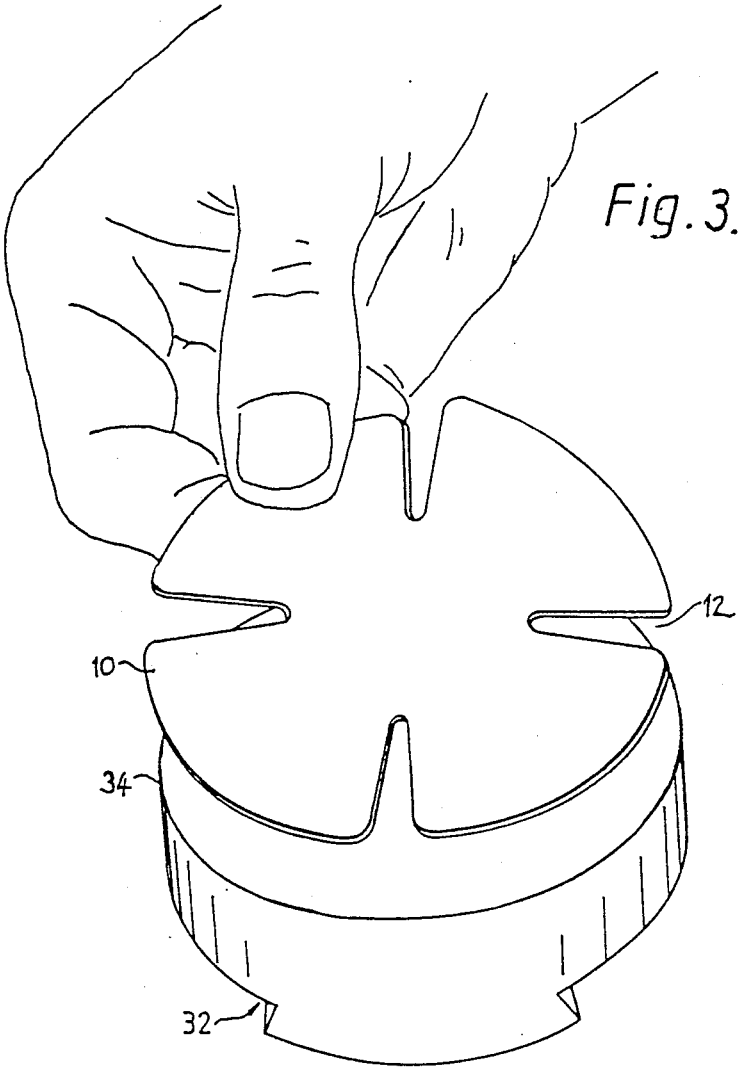
Fig. 3.
Fig. 5.
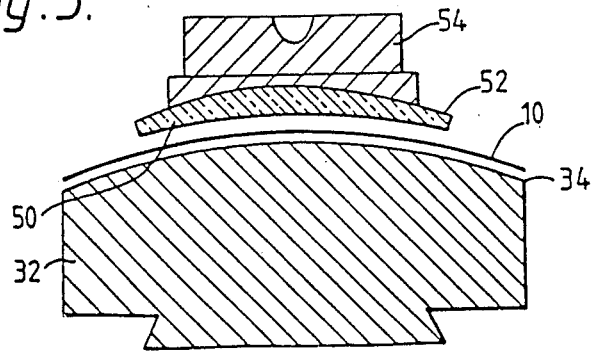

LENS LAPPING PAD

BACKGROUND OF THE INVENTION

This is a continuation of Ser. No. 133,380, filed Dec. 15, 1987, now abandoned.

This invention relates to a lens lapping pad adapted to be attached to the working surface of a tool for lapping an optical lens.

Optical lenses are generally lapped by means of a tool having a carefully machined surface which conforms to that desired on one face of an optical lens. Sometimes the same tool has two surfaces—one for lapping one side of the lens and the other for lapping the other side of the lens. Usually the working surface or surfaces on these tools are of simple or torroidal convex or concave shape.

In order to reduce the rate of wear on the said working surfaces of these tools, it is usual to apply to them an adhesive-backed replaceable pad or foil which is sufficiently thin to be brought into conformity with the convex or concave working surface of the tool. Various forms of pad have been proposed in the past, including aluminium pads, steel pads and pads made of perforated metal so that slurry can be retained in the perforations.

Hitherto, lens lapping pads have comprised a metal foil of about 0.20 mm thickness, provided with an adhesive backing by which the pad is secured to a tool.

An improved ability of the pad to conform to the curvature of the working face of a tool is obtained with a thickness of 0.10 mm, but conventional adhesives do not provide sufficient overall thickness of the pad to make it useful for tool systems already in use which have working faces corrected for a pad thickness of about 0.50 mm. If such conventional adhesives are simply made thicker, it is difficult to obtain uniform thickness of the adhesives, or if it is applied to the foil in a uniform manner, it becomes too easily distorted when applied to the tool working surface. That would lead to serious errors in the lens lapping process.

SUMMARY OF THE INVENTION

The present invention seeks to provide a remedy.

Accordingly, the present invention is directed to a lens lapping pad comprising a metal foil having a thickness substantially in the range from 0.07 mm to 0.13 mm, and a backing of cloth impregnated with a pressure sensitive adhesive, to give an overall pad thickness substantially in the range from 0.35 mm to 0.60 mm.

Such a pad provides a further advantage that it can be readily and cleanly peeled off the tool after use.

The invention also extends to an assembly comprising a lapping tool with a lapping pad laid on and conforming to a working surface of the lapping tool.

BRIEF DESCRIPTION OF THE DRAWINGS

Examples of lens lapping pads made in accordance with the present invention as well as illustrations of the way in which they are used are shown in the accompanying drawings, in which:

FIG. 3 is a perspective view of an optical tool having a lens lapping pad of the form shown in FIGS. 1 and 2 being attached to its convex working surface;

FIG. 5 is a cross-sectional view of an optical tool prepared as shown in FIG. 4 and a lens and lens holding assembly, ready for work on the lens.

DETAILED DESCRIPTION OF THE PREFERRED EMBODIMENTS

Figure 1:
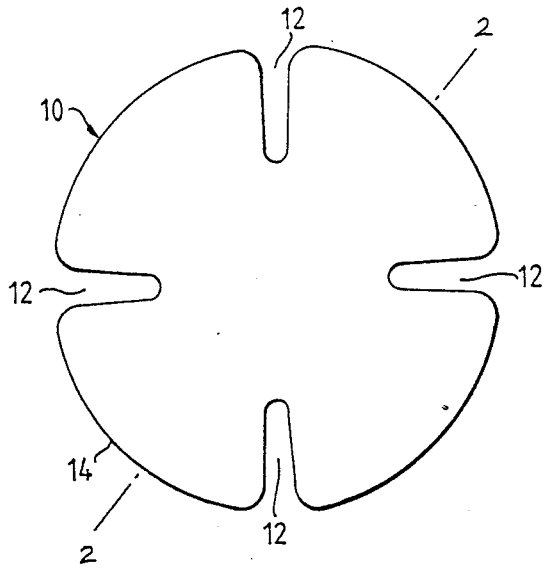
FIG. 1 is a plan view of a first such example of lens lapping pad.

The lens lapping pad 10 shown in FIG. 1 is generally circular and has four radial slots 12 which extend inwardly from the periphery 14 of the pad, are open at the periphery 14, and are spaced uniformly around it. These slots are commonly found in lens lapping pads, and ease the fixing of an intended lower surface of the pad into close conformity with the working surface of an optical tool.

Figure 2:
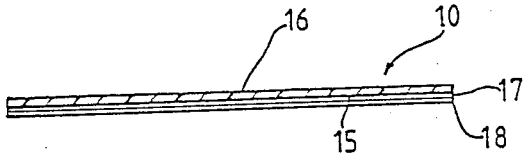
FIG. 2 is a cross-section of the pad along the line II—II of FIG. 1, with a greatly exaggerated thickness for the sake of clarity.

As can be seen from FIG. 2, before the pad is attached to an optical tool, it has an underneath surface 15 of a zinc alloy foil 16 of the pad, on which is provided an adhesive backing 17 protected by a peelable paper cover 18.

The zinc alloy foil 16 has a thickness substantially in the range from 0.07 mm to 0.13 mm, and is preferably 0.10 mm thick. The adhesive backing 17 comprises a cloth 20 impregnated with a pressure sensitive adhesive 22. The backing preferably comprises "L.26X" double-sided cloth tape manufactured by Arno adhesive tapes of Southampton, England. This is a cotton cloth tape with a natural rubber based pressure sensitive adhesive on both sides. It has a thickness of about 0.35 mm, and it gives an overall thickness of the pad of about 0.45 mm. Preferably, the pad has a thickness in the range from 0.35 mm to 0.60 mm, most preferably 0.50 mm, to conform to conventional systems, where tools have been made to allow for that thickness of pad.

Such a pad has good flexibility because the thin foil and the cloth core of the adhesive conform well to the working surface of a tool, it is compatible with current tool systems, and peels away from the tool surface very cleanly after use.

FIG. 3 shows a lens lapping pad 10 being placed by hand onto the top of an optical tool 32. The lapping pad is secured to the tool working surface by hand pressure exerted on the top of the pad, to effect a bond between the pad and the tool by means of the pressure sensitive adhesive.

Figure 4:
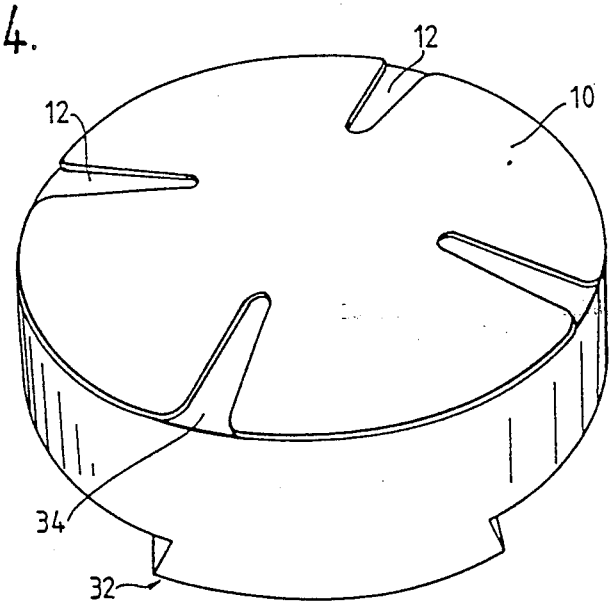
FIG. 4 is a perspective view of an optical tool as shown in FIG. 3 and a lapping pad adhered to the working surface of the tool.

In FIG. 4 an optical tool 32 has a lens lapping pad 10 like the one illustrated in FIGS. 1 and 2 attached to its convex working face 34. The protective paper cover 18 shown in FIG. 2 has been peeled off and the pad has been pressed against the tool to create a bond between the lower surface 15 of the pad and the convex surface 34 of the tool by virtue of the adhesive layer 17.

Whilst the optical tool has been shown with a convex working surface, it is to be understood that the surface could equally well be concave, for lapping a convex surface on an optical lens.

The effective curvature of the tool shown in FIG. 4 is thus determined by the convex working surface 34 itself together with an allowance for the thickness of the pad which in this case is about ⅛ dioptre.

FIG. 5 shows an assembly ready for lapping, the lapping pad 10 having been bonded to the tool 32.

An optical lens 52 mounted on a lens-holding block 54 is held with its concave surface 50 in contact with the convex upper surface of the lens lapping pad 10, ready for the polishing operation. The relative movement between the tool and the block to accomplish this is usually complex, but the means which effect this movement are well known in the optical industry and are not described here in detail.

Figure 6:
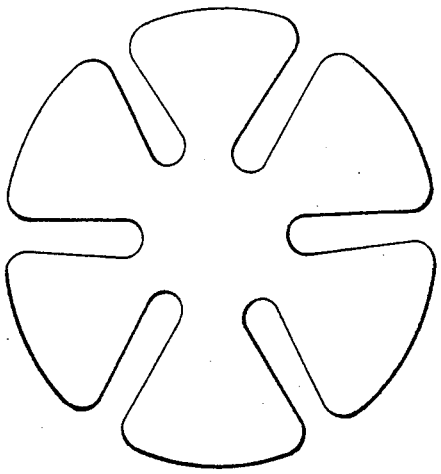
FIGS. 6 and 7 are plan views of modified forms of lens lapping pad.

FIG. 6 is a plan view of a modified form of lens lapping pad in accordance with the present invention. This example has six radial slots.

Figure 7:
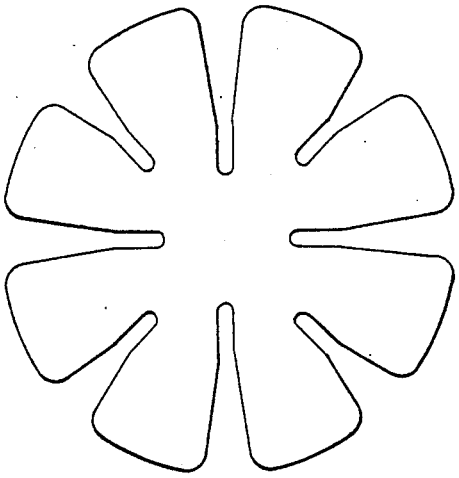

The further modified form illustrated in FIG. 7 has eight radial slots. Alternate slots extend further towards the centre of the pad, and each slot has an inner part with parallel sides or sides converging in a direction away from the centre of the pad towards the open end of the slot, and an outer part with straight sides diverging in that direction. The pad may have a diameter of 75 mm.

The lens lapping pads shown have smooth, accurate surfaces. Their thicknesses are in the range from 0.35 mm to 0.60 mm and their diameters from 50 mm to 150 mm.

The number of slots in the illustrated examples is four, six and eight, but any number from four to eight is acceptable.

The zinc alloy of the foil 16 is preferably made by alloying zinc of 99.95% purity with the following:

| | |
|---|---|
| Copper | .70 to .85% |
| Titanium | .10 to .12% |
| Manganese | .10 to .12% |

Impurities are then controlled to:

| | |
|---|---|
| Lead | .005% maximum |
| Cadmium | .003% maximum |
| Iron | .010% maximum |
| Tin | .002% maximum |

I claim:

1. A lens lapping pad comprising a metal foil having a thickness substantially in the range from 0.07 mm to 0.13 mm, and a tool-adherable backing of cloth impregnated with a pressure sensitive adhesive, to give an overall pad thickness substantially in the range from 0.35 mm to 0.60 mm, in which the cloth has one of its sides firmly attached to the metal foil by means of adhesive, and in which pressure sensitive adhesive is present on the other side of the cloth, being the side further from the metal foil, by means of which the pad may be removably attached to the working surface of a lens lapping tool with the cloth between the tool and the metal foil, and in which the pad is continuous across at least one diameter thereof, being substantially equal to the diameter of the working surface of a lens lapping tool.

2. A pad according to claim 1, in which the metal foil has a thickness of substantially 0.1 mm.

3. A pad according to claim 1, in which the pad has an overall thickness of substantially 0.5 mm.

4. A pad according to claim 1, having a diameter substantially in the range from 50 to 150 mm.

5. A pad according to claim 4, having a diameter of substantially 75 mm.

6. A pad according to claim 1, in which the cloth backing comprises cotton cloth.

7. A pad according to claim 1, in which the cloth backing is impregnated with a natural rubber based pressure sensitive adhesive.

8. A pad according to claim 1, in which the cloth backing is impregnated with a pressure sensitive adhesive on both sides of the backing.

9. A pad according to claim 1, in which said metal foil comprises a zinc alloy.

10. A pad according to claim 9, in which the alloy is made with zinc of 99.95% purity.

11. A pad according to claim 9, in which the zinc alloy comprises copper substantially in the range 0.7 to 0.85% by weight, titanium substantially in the range from 0.1 to 0.12% by weight, and manganese substantially in the range from 0.1 to 0.12% by weight.

12. A pad according to claim 11, in which impurities are controlled to 0.005% by weight maximum for lead, 0.003% by weight maximum for cadmium, 0.01% by weight maximum for iron, and 0.002% by weight maximum for tin.

13. A pad according to claim 1, which is provided with a plurality of radially extending slots which are open at the periphery of the pad.

14. A pad according to claim 1, in which the cloth backing is protected by a peelable cover.

15. A lens lapping assembly comprising a lapping tool and a pad as claimed in claim 1 laid on and conforming to a working surface of the lapping tool.

16. A lens lapping pad comprising a zinc alloy foil having a thickness substantially in the range from 0.07 mm to 0.13 mm, and a tool-adhesive backing of cloth impregnated with a pressure sensitive adhesive, to give an overall pad thickness substantially in the range from 0.35 mm to 0.60 mm, in which the zinc alloy comprises copper substantially in the range from 0.7 to 0.85% by weight, titanium substantially in the range from 0.1 to 0.12% by weight, and manganese substantially in a range from 0.1 to 0.12% by weight.

17. A pad according to claim 16, in which impurities are controlled to 0.005% by weight maximum for lead, 0.003% by weight maximum for cadmium, 0.01% by weight maximum for iron, and 0.002% by weight maximum for tin.

* * * * *